US005181477A

United States Patent [19]

Harken et al.

[11] Patent Number: 5,181,477

[45] Date of Patent: Jan. 26, 1993

[54] BOOM FOR SAILING VESSEL

[75] Inventors: Olaf T. Harken, Pewaukee, Wis.; Eric R. D. Hall, Bristol; S. Dirk Kramers, Tiverton, both of R.I.

[73] Assignee: Harken, Inc., Pewaukee, Wis.

[21] Appl. No.: 836,191

[22] Filed: Feb. 13, 1992

Related U.S. Application Data

[63] Continuation of Ser. No. 577,885, Sep. 5, 1990, abandoned.

[51] Int. Cl.[5] ..... B63B 35/00

[52] U.S. Cl. ..... 114/39.1; 114/106

[58] Field of Search ..... 114/39.1, 97, 98, 89, 114/90, 102-112

[56] References Cited

U.S. PATENT DOCUMENTS

| | | | |
|---|---|---|---|
| 2,561,253 | 7/1951 | Wells-Coates | 114/97 |
| 3,331,348 | 7/1967 | Dyer | 114/112 X |
| 4,679,520 | 7/1987 | Harken | 114/104 |
| 4,723,498 | 2/1988 | Stampe | 114/98 X |
| 4,811,677 | 3/1989 | Pederson et al. | 114/89 |

*Primary Examiner*—Edwin L. Swinehart
*Attorney, Agent, or Firm*—Juettner Pyle & Lloyd

[57] ABSTRACT

A boom for a sailing vessel has a forked forward portion hinged to the mast at spaced locations to permit rotation or swinging of the boom only in a horizontal plane.

11 Claims, 6 Drawing Sheets

BOOM FOR SAILING VESSEL

This is a continuation of copending application Ser. No. 07/577,885 filed on Sep. 5, 1990, now abandoned.

BACKGROUND OF THE INVENTION

This invention relates to rigging for sailing vessels and more particularly to a boom and the attachment between the boom and an upright support structure such as a mast.

In conventional sailing vessels having a mast, a boom is employed to support the lower edge of the mainsail. The boom, usually constructed of extruded aluminum, is connected at one end of the mast by a swivel or gooseneck fitting. The clew of the mainsail is supported at the other end of the boom, usually in an adjustable manner, using an outhaul. The leading edge of the mainsail, or luff, is supported in a slot or track extending lengthwise on the mast, with the tack being secured to the boom.

By necessity, numerous controls are employed to control the position of the boom, which is swingable approximately 180 degrees behind the mast, and the free end is tiltable upwardly. Conventionally, a traveler is mounted across the boat near the free end of the boom, and a mainsheet system is connected between the traveler and the boom. This system serves to control the extent of outward movement of the boom and also serves to hold the end of the boom down, as long as the attachment point of the mainsheet at the deck is beneath the attachment point on the boom. The traveler allows the lower attachment point to move back and forth athwartships to extend the range of downward force of the mainsheet.

At certain points of sailing, such as during reaching or running, the boom extends beyond the end or extent of control of the traveler, and a separate control, known as a boom vang, is employed to restrain upward movement of the end of the boom. The vang usually extends between the base of the mast and a location about one quarter of the length of the boom behind the gooseneck. The vang is employed as a tension member and is typically constructed from wire, rope, or telescoping rods or pipes, which may include a piston operation.

Finally, a topping lift must be employed to prevent downward sag of the free end of the boom when the sail is lowered. The topping lift is typically between the top of the mast and the end of the boom.

In addition, the boom may be provided with an elongated cylindrical cavity to enable furling or reefing of the mainsail into the boom. For example, the foot of the mainsail may be attached to an elongated shaft or tube extending the length of the cavity. The tube may be rotated to roller reef or furl the sail from the foot as the halyard is released. In most applications the angle maintained between the boom and mast is highly critical in order to allow the sail to roll up evenly. Even a slight deviation from the critical angle may cause bunching of the sail at one end and jamming of the system.

Since the mainsail is triangular, the furling operation requires that a greater quantity of sail material must be accommodated in the forward portion of the boom. If a conventional single extrusion is used to make the boom, this may require the boom to have a cross section which is excessively large, heavy and bulky.

SUMMARY OF THE INVENTION

An object of the present invention is to provide a boom for a sailing vessel which requires fewer controls for adjustment and proper operation.

Another object of the present invention is to provide a boom attached to an upright support such as a mast, in which the angle between the support and boom will remain constant at various points of sail without the need for a traveler or vang.

Another object of this invention is to provide a boom having a streamlined shape and a high strength to weight ratio.

A further object of this invention is to provide a boom having an internal furling cavity which is larger at the forward end than at the free end.

A yet further object of this invention is to provide a boom attached to an upright support in which the boom is swingable to its full extent in a fixed substantially horizontal plane, and means are provided to quickly allow release of the boom from said fixed plane.

The above objectives are accomplished in accordance with the present invention by the provision of a boom constructed from a molded fiber reinforced polymer or resin having a bifurcated or forked forward portion comprising at least two legs which are separately hinged to the upright support or mast about a substantially vertical axis. This method of attachment limits movement of the boom to an arc in substantially a horizontal plane behind the mast and prevents vertical upward or downward movement of the end of the boom, thereby eliminating the necessity for the use of a traveler, vang and topping lift to otherwise support or restrain the boom.

The boom of the present invention can be molded into a streamlined shape and may be provided with an elongated tapered cavity to enable mainsail furling. A quick release may also be provided to allow upward tilting of the boom in the event of an emergency, such as in the event the boom strikes the water.

THE DRAWINGS

DESCRIPTION OF THE PREFERRED EMBODIMENTS

In Connection with the specification and claims, the terms "forward", "aft", "horizontal" and "vertical" are being employed in their customary sense wherein the mast of a sailing vessel extends generally vertically relative to the waterline, and the boom extends generally horizontally and rearwardly from the mast.

Figure 1:
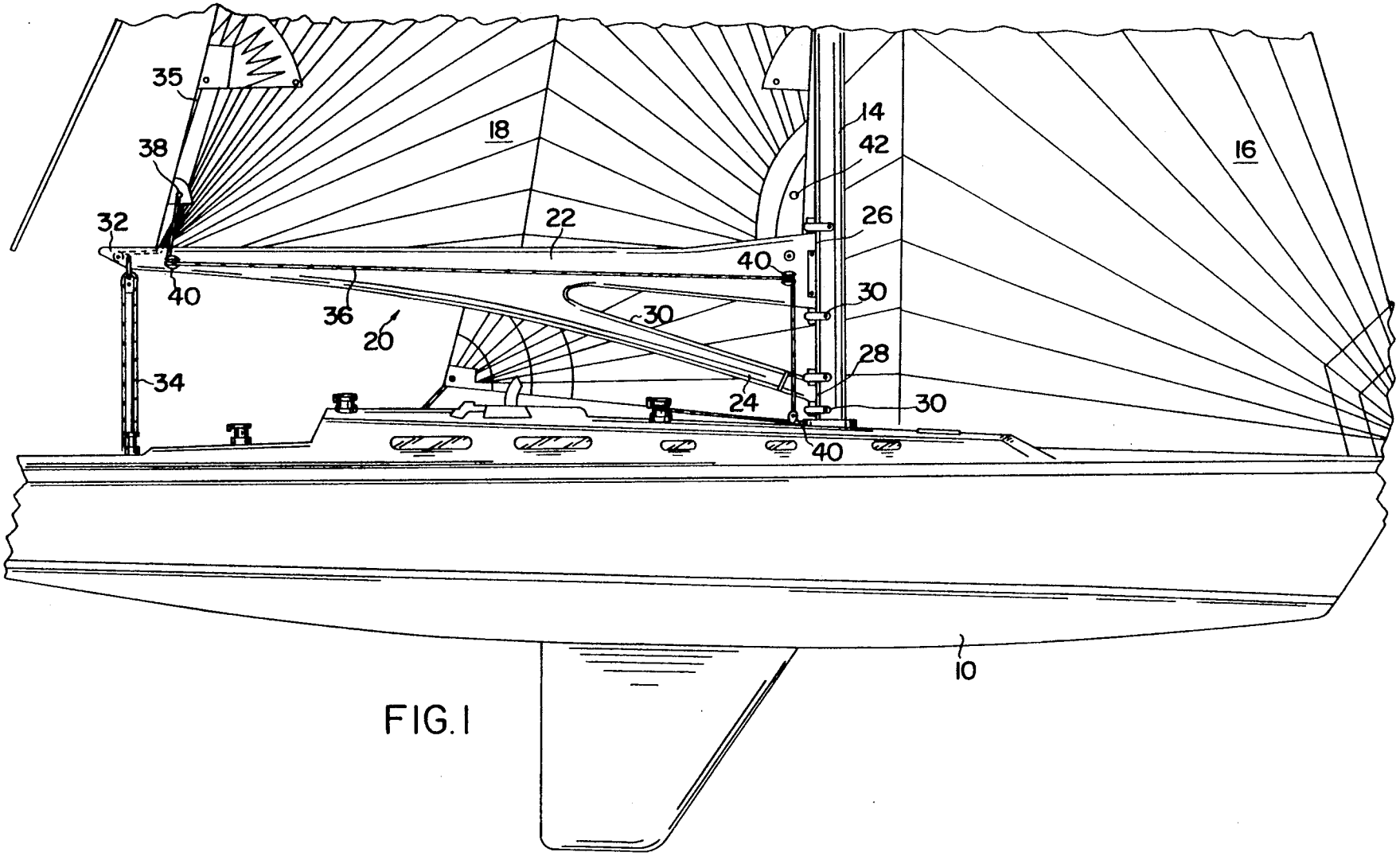
FIG. 1 is a side view of a portion of a sailing vessel, illustrating the boom and mounting system of the present invention.

FIG. 1 illustrates a conventional sailboat having a hull 10, deck structure 12 and upright mast 14 supported by rigging in a conventional manner, with the mast supporting a foresail 16 and a mainsail 18.

The boom of the present invention is generally shown at 20, and is connected to and extends rearwardly from the mast 14 or other upright support. The boom is of one piece construction and is fabricated from a composite comprising a fiber or fabric reinforced cured polymer. For example, the boom may be molded in halves using conventional techniques employed in the molding of sailboat hulls, and the halves may be secured together using a high strength adhesive. The plastic resin is used to impregnate reinforcing yarns or fabrics, such as aramid, carbon, glass, or the like, and the material is pressed into the mold until the resin has cured. The elongate portion of the boom 20 will preferably be hollow in the center to achieve savings in weight. Additional reinforcing elements such as solid metallic rods or tubes may be included if needed.

The boom 20 comprises an elongated main straight body portion 22 having a slot in the upper wall thereof to receive and retain the boltrope attached to the foot of the mainsail 18 in a conventional fashion. The forward portion of the boom is bifurcated or has a leg 24 extending downwardly on an angle from the main portion 22. Both the main portion 22 and depending leg 24 terminate at respective spaced ends 26 and 28 which are connected to the mast 14 as hereinafter described. The connection between the main portion 22 and leg 24 defines an open U-shaped slot 30, which is advantageous in terms of weight savings. Obviously, however, the slot 30 may be filled with a web or other cross support structure if needed.

The ends 26 and 28 of the boom portions are connected to the mast by hinges 30 which allow rotation of the boom only in a horizontal plane. As shown, the hinges 30 may be of the conventional pintle-gudgeon type including a plurality of overlapping eyelets secured from the ends of the boom and from the mast and hingedly connected by vertical pins, as shown. This arrangement causes the free end 32 of the boom 20 to be supported against both upward and downward movement and eliminates the need for a topping lift or vang. As shown, the boom position may be adjusted by the use of a simple multi-part pulley and line main system 34 connected between a fixed location on the deck structure 12 and a location near the end 32 of the boom.

FIG. 1 also illustrates the possibility of adjusting the tension along the leech and luff of the sail, or alternatively, reefing the sail to decrease its area. With respect to the leech 34, a line 36 may be secured to a reef point 38 in the leech, and led around one or a series of bearing blocks 40 on the boom toward the mast and to the deck. A similar arrangement can be used to control tension on or reef the luff edge of the sail via an attachment point 42 near the luff.

Figure 2:
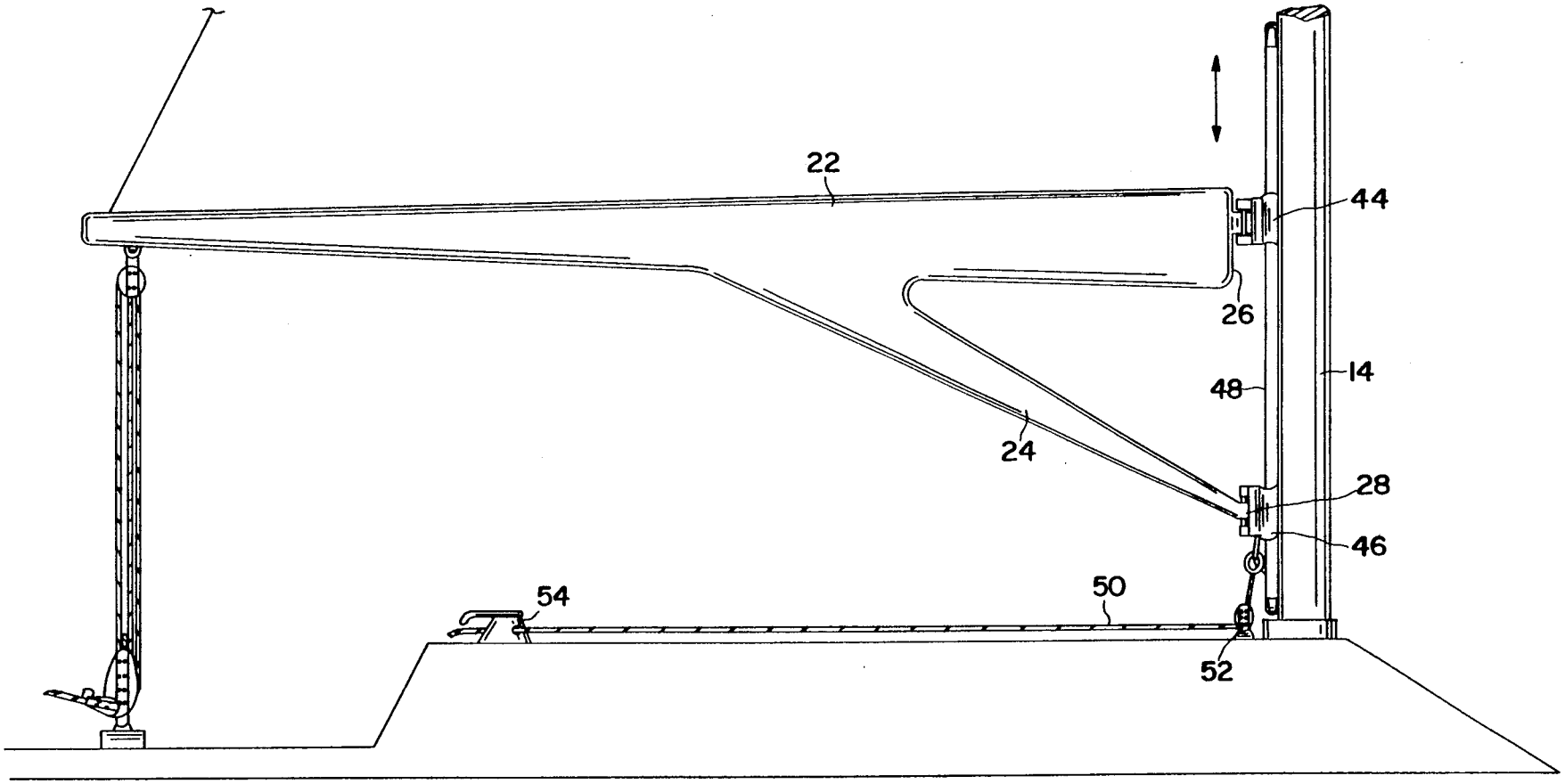
FIG. 2 is a side view of a portion of a sailing vessel showing a boom of the present invention mounted on a track on the mast to enable vertical adjustment and upward release.

FIG. 2 illustrates a modification of the embodiment shown in FIG. 1 wherein the ends 26 and 28 of the main portion 22 and leg 24 are hinged to spaced cars 44 and 46 slidably mounted on an elongated vertical track 48 secured to the rear of the mast 14. A line 50 is attached to the lower car 46 and is led downwardly around a pulley 52 near the base of the mast, with the free end being secured by a cleat or sheet stopper 54 secured to the deck structure. The line, when secured, may provide a downhaul function to adjust the shape of the mainsail. Also, the line may be quickly released to allow the boom and the free end thereof to be quickly raised. This ability may be advantageous in the event of a sudden knockdown in which a strong puff of wind causes the boat to heel so excessively that the end of the boom strikes the water and endangers the boom, mast, and associated rigging.

Figure 3:
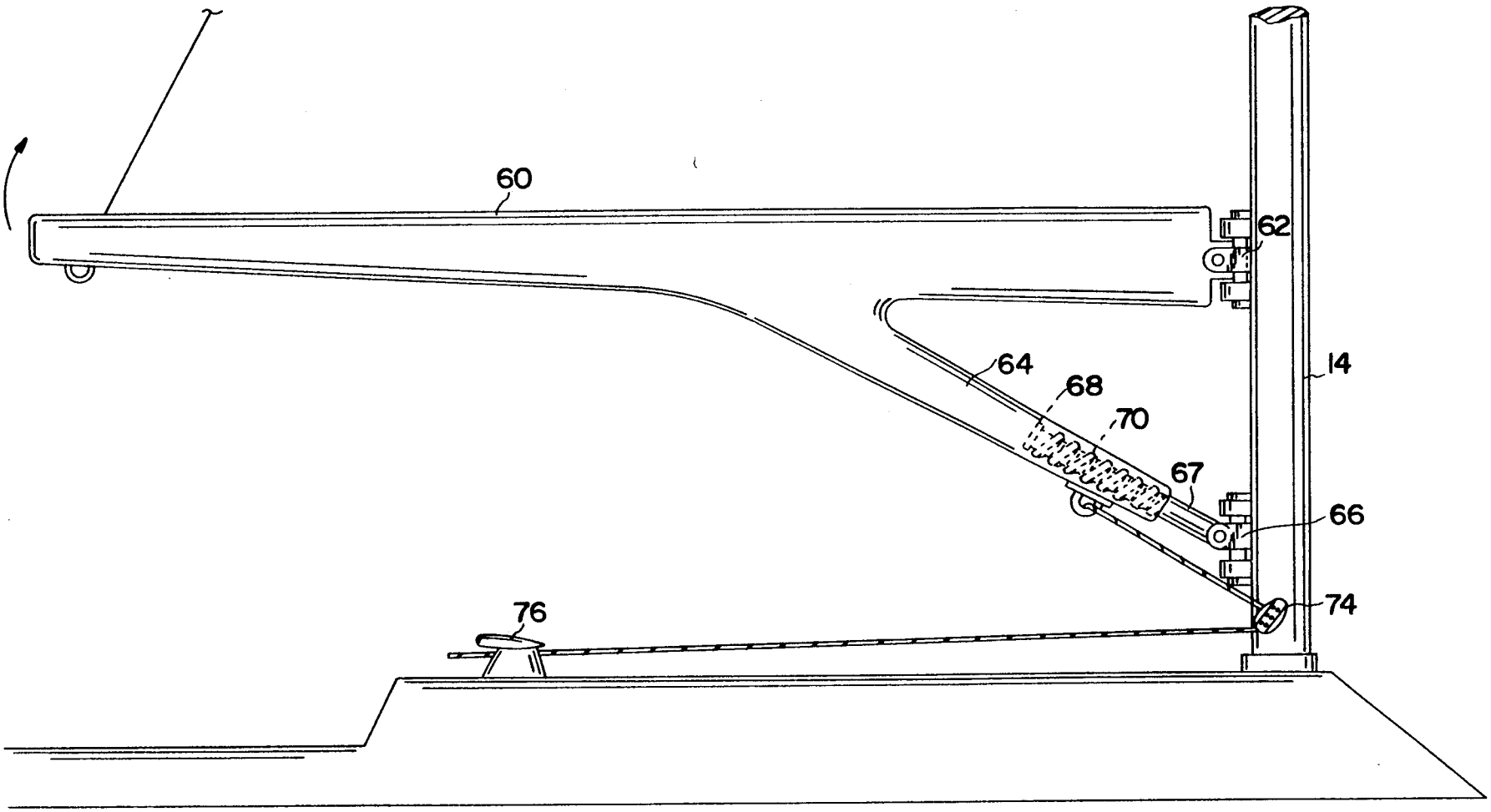
FIG. 3 is a side view of a portion of a sailing vessel illustrating the boom of the present invention and a quick release mechanism.

FIG. 3 shows another embodiment with quick release features. In this version, the forward end of the upper portion of the boom 60 is connected to the mast 14 by means of a universal joint 62 allowing swinging motions of the boom in both horizontal and vertical directions. The lower leg 64 is connected to the mast 14 by means of a hinge 6 allowing movement only in a fixed horizontal plane. In this embodiment, the lower leg 64 is a hollow tubular structure terminating short of the mast. A rod 67 is hinged at one end to the mast by means of the hinge 66, with the other end terminating in a piston 68 slidably received in the tubular leg 64. A spring 70 is provided and retained between the piston and the end of the tube. The spring has sufficient strength to allow upward tilting movement of the boom only in the event of a strong force being exerted against the end of the boom. The boom my also be held in a fixed or locked position by means of a line 72 secured to the leg 66 and extending downwardly to a pulley 74 at the base of the mst and to a cleat 76.

Figure 4:
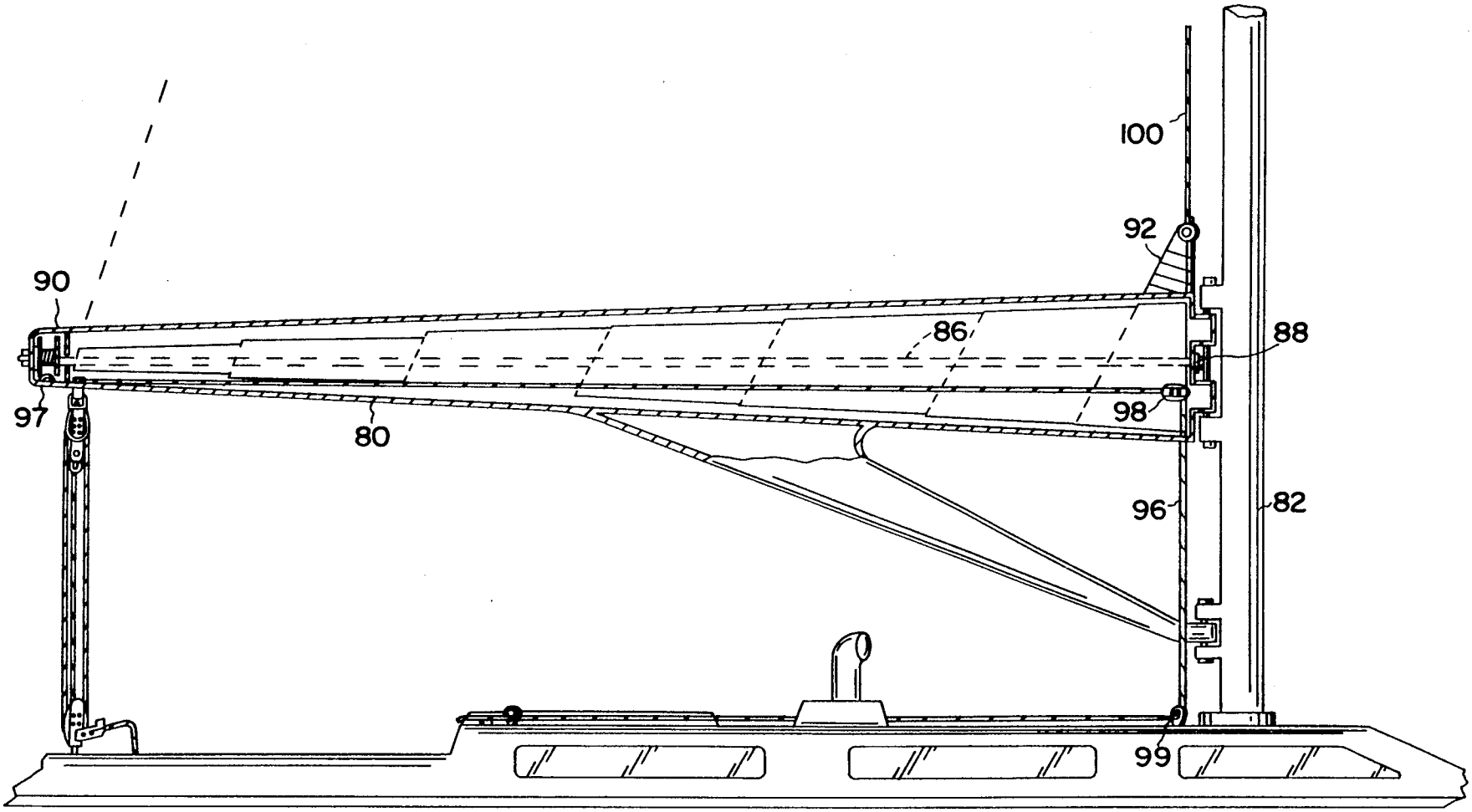
FIG. 4 is a side view, partially in vertical section, of a sailing vessel and boom of the present invention including a furling system.
Figure 5:
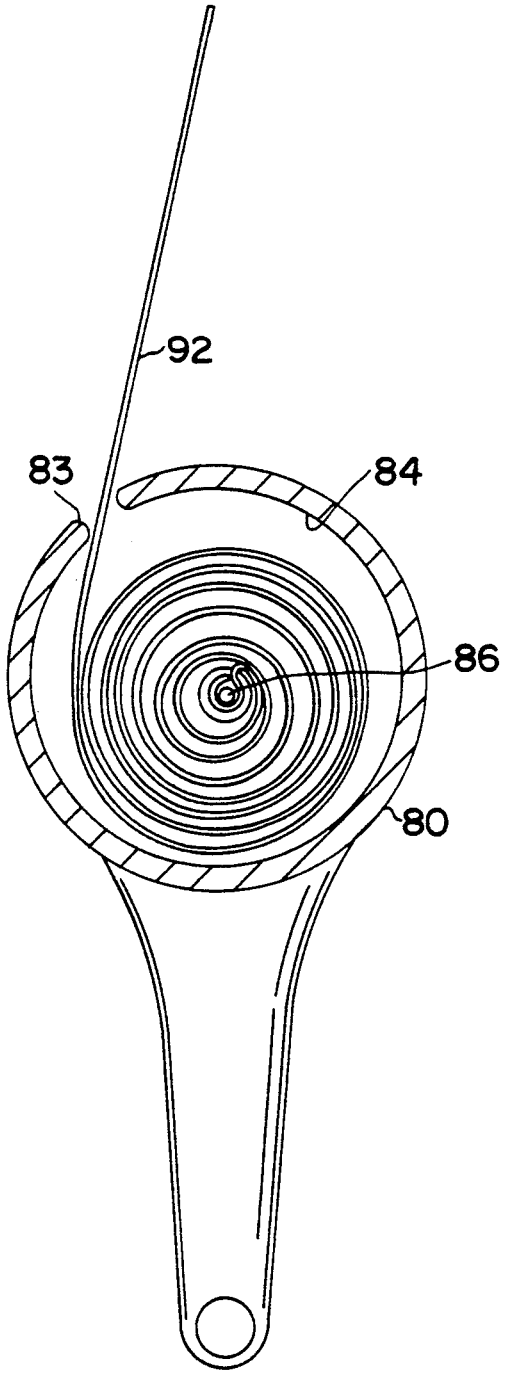
FIG. 5 is a sectional view along line 5—5 of FIG. 4.

FIGS. 4 and 5 illustrate the advantages of using the boom of the present invention in connection with roller furling gear. As described in the previous embodiments, the boom 80 is bifurcated and is hinged to the mast 82 at spaced locations to allow swinging through a 180 degree and behind the mast in a fixed horizontal plane. The upper part of the boom comprises a sail entrance slot 83 leading into a hollow cavity 84 which is cone shaped or decreasing in size from the forward to rear portion. A shaft 86 is located along the central longitudinal axis of the cavity and is supported by bearings in an opening in the mast at 88 and in the free end of the boom at 90. The foot of the sail 92 is attached to the shaft 86 to enable roller furling of the sail around the shaft as shown. For this purpose, a reel 94 is secured to the shaft 86 at the end of the boom, and a line 96 is wrapped around the reel. The free end of the line may be passed through a series of pulleys such as 97, 98 and 99 to enable manual operation of the reel to wind up or furl the sail around the shaft upon gradual release of the halyard 100 attached to the head of the sail.

Figure 6:
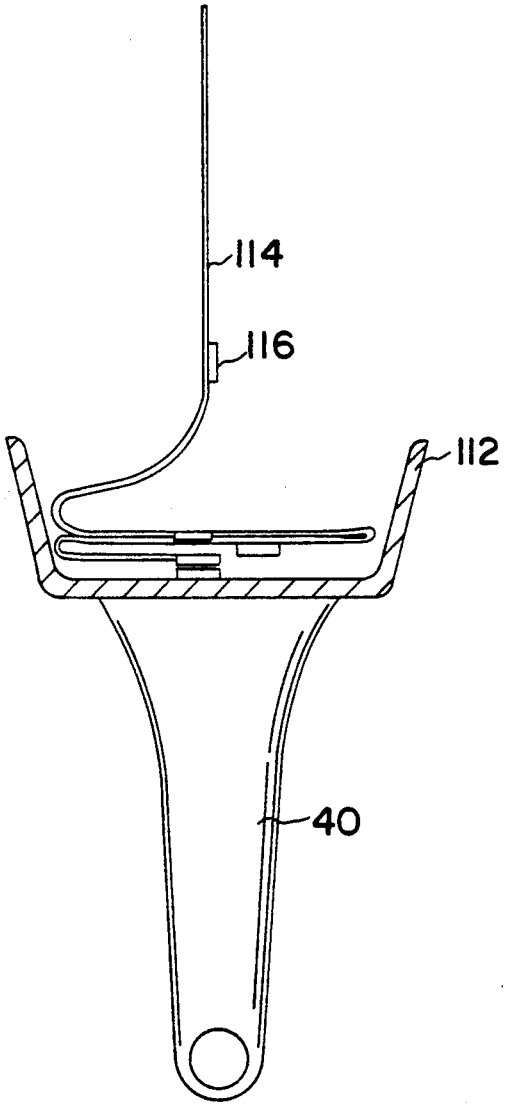
FIG. 6 is a view similar to FIG. 5 showing a different sectional configuration.

FIG. 6 illustrates a modified section of a boom 110 in which the upper portion is shaped in the form of an upwardly facing dish 112 to enable flaking of a sail 114, especially one having full length battens 116 into the confines of the dish. Due to the molded construction, many different configurations can be adopted.

It may be seen that by providing a boom of molded construction, the cavity in the boom may be designed and configured to precisely accommodate the body of the sail upon furling, especially at the luff, wherein a greater bulk of cloth must be furled, together with the boltrope carried in the mast groove. In addition, it is possible to maintain the boom at a precise angle relative to the mast, typically in the order of 80 to 100 degrees, to allow even and uniform furling of the sail.

We claim:

1. In a sailing vessel having an upright member for supporting a boom for a sail, the improvement wherein said boom comprises an elongate member extending rearwardly and generally horizontally from the upright member and terminating at a free end, first hinge means for connecting the forward end of said elongated member to said upright member, an elongate leg extending forwardly and downwardly from said elongate member to a point generally vertically aligned with the forward end of the elongate member, said leg being integral with said elongate member, and second hinge means for connecting said leg to said upright support at a location spaced from said first hinge means, at least one of said hinge means permitting rotation of said boom only in a substantially fixed horizontal plane.

2. The improvement of claim 1 wherein said first hinge means provides for upward tilting of the free end of said elongate member, and said leg comprises means for permitting movement of said leg away from said second hinge means.

3. The improvement of claim 1 wherein said elongate member comprises an elongate cavity having a central axis, a slot in an upper portion of said elongate member leading to said cavity, a shaft mounted for rotation along said central axis, the lower edge of said sail being attached to said shaft, and means for rotating said shaft to furl said sail in said cavity around said shaft.

4. The improvement of claim 3 wherein said elongate cavity is larger at the forward end thereof.

5. The improvement of claim 1 wherein said first hinge means permits rotation of said boom in horizontal and vertical planes, and said second hinge means permits rotation of said boom only in a horizontal plane.

6. The improvement of claim 5 wherein means are provided for quickly disengaging said second hinge means to allow rotation of said boom in a vertical plane.

7. In a sailing vessel having an upright member for supporting a boom for a sail, the improvement wherein said boom comprises an elongate member extending rearwardly and generally horizontally from the upright member and terminating at a free end, a leg extending forwardly and downwardly from said elongate member to a point generally vertically aligned with the forward end of the elongate member, a vertical track secured to said upright support, first and second cars slidably mounted on said track, and first and second hinge means for connecting the forward end of said elongate member and said leg to said first and second cars, respectively, at least on of said hinge means permitting rotation of said boom only in a substantially horizontal plane.

8. The improvement of claim 7 additionally comprising means for releasably restraining upward movement of said cards on said track.

9. The improvement of claim 7 additionally comprising means for controlling movement of said cars or said track.

10. The boom for claim 7 wherein said boom is composed of a reinforced polymer resin.

11. The boom of claim 7 wherein said elongate member terminates at an outer end, and wherein said member is tapered toward said outer end.

* * * * *